US005751227A

United States Patent [19]

Yoshida et al.

[11] Patent Number: 5,751,227

[45] Date of Patent: May 12, 1998

[54] COMMUNICATION SYSTEM FOR VEHICLES

[75] Inventors: Ichiro Yoshida, Takahama; Taisei Kato, Toyoake; Toshihide Ando, Chita-gun; Manabu Matsumoto; Mutsushi Yamashita, both of Handa; Yoshiyuki Kago, Nishio, all of Japan

[73] Assignee: Nippondenso Co., Ltd., Kariya, Japan

[21] Appl. No.: 881,121

[22] Filed: Jun. 24, 1997

Related U.S. Application Data

[63] Continuation of Ser. No. 574,635, Dec. 19, 1995, abandoned.

[30] Foreign Application Priority Data

Dec. 22, 1994 [JP] Japan ..... 6-320208

[51] Int. Cl.[6] ..... G08G 1/00

[52] U.S. Cl. ..... 340/928; 340/907; 340/917; 343/700 MS; 343/711; 701/117; 455/107

[58] Field of Search ..... 340/917, 928, 340/933, 943, 907; 343/700 MS, 711; 701/117, 118, 119; 455/107, 121, 193.1

[56] References Cited

U.S. PATENT DOCUMENTS

| | | | |
|---|---|---|---|
| 4,203,116 | 5/1980 | Lewin | 343/700 MS |
| 4,713,670 | 12/1987 | Makimoto et al. | 343/700 MS |
| 4,908,615 | 3/1990 | Bayraktaroglu | 340/917 |
| 5,164,732 | 11/1992 | Brockelsby | 342/44 |
| 5,192,954 | 3/1993 | Brockelsby et al. | 342/42 |
| 5,196,846 | 3/1993 | Brockelsby et al. | 340/933 |
| 5,227,803 | 7/1993 | O'Connor et al. | 342/442 |
| 5,266,785 | 11/1993 | Sugihara et al. | 235/384 |
| 5,307,349 | 4/1994 | Shloss et al. | 340/825.54 |
| 5,309,164 | 5/1994 | Dienes et al. | 343/700 MS |
| 5,387,916 | 2/1995 | Cohn | 342/44 |
| 5,416,486 | 5/1995 | Koert et al. | 342/42 |
| 5,425,032 | 6/1995 | Shloss et al. | 340/825.54 |
| 5,485,520 | 1/1996 | Chaum et al. | 380/24 |
| 5,621,571 | 4/1997 | Bantli et al. | 340/907 |

FOREIGN PATENT DOCUMENTS

| | | |
|---|---|---|
| 0 609 453 | 8/1994 | European Pat. Off. . |
| 613108 | 8/1994 | European Pat. Off. . |
| 616302 | 9/1994 | European Pat. Off. . |
| 55-116176 | 9/1980 | Japan . |
| 4-311291 | 11/1992 | Japan . |
| 4-315282 | 11/1992 | Japan . |
| 5-314325 | 11/1993 | Japan . |
| 5-324967 | 12/1993 | Japan . |
| 6-131509 | 5/1994 | Japan . |

*Primary Examiner*—Jeffery Hofsass
*Assistant Examiner*—Timothy Edwards, Jr.
*Attorney, Agent, or Firm*—Cushman Darby & Cushman IP Group of Pillsbury Madison & Sutro LLP

[57] ABSTRACT

A communication system for vehicles, which obtains exact communication processing with responders mounted on vehicles running on a road having a plurality of traffic lanes, is disclosed. An expressway has three traffic lanes. A gantry is disposed in a specified position on the expressway. On the gantry are disposed antenna units to counter the traffic lanes respectively. The antenna units are provided with communication areas by means of a pair of antenna elements respectively. The antenna element is composed of a microstrip array antenna disposed with eight pieces of patches laid out in two rows with four pieces in each row. The antenna units controls communication processing to communicate with vehicles adjoining each other. When response signals are sent from a vehicle mounted responder, the vehicle mounted responder is fixed and communication processing for toll collection is performed. As a result, communication processing with responders mounted on vehicles respectively which are running in the respective traffic lanes can exactly be performed.

21 Claims, 19 Drawing Sheets

ANTENNA UNIT 16 OUTPUT
UNMODULATED CARRIER WAVE
Δt
PLT

ANTENNA UNIT 17 OUTPUT
Δt/2
UNMODULATED CARRIER WAVE
PLT

ANTENNA UNIT 18 OUTPUT
UNMODULATED CARRIER WAVE
PLT
RC1
WD1
ACK1
RC2
WD2
ACK2

VEHICLE MOUNTED RESPONDER 34 OUTPUT
WAKE-UP
RSP2
RD2
END2
SLEEP

VEHICLE MOUNTED RESPONDER 35 OUTPUT
WAKE-UP
RSP1
RD1
END1
SLEEP
t 0
t 1
t 2
t 3
t 4
t 5
t 6
t 7
TIME

ANTENNA UNIT 16 OUTPUT
UNMODULATED CARRIER WAVE
PLT

ANTENNA UNIT 17 OUTPUT
UNMODULATED CARRIER WAVE
PLT2
RC2
WD2
ACK2
(RESPONDER 35)

ANTENNA UNIT 18 OUTPUT
UNMODULATED CARRIER WAVE
PLT1
RC1
WD1
ACK1

VEHICLE MOUNTED RESPONDER 34 OUTPUT
WAKE-UP
PSP1
RD1
END1
SLEEP

VEHICLE MOUNTED RESPONDER 35 OUTPUT
X
(ANTENNA UNIT 17)
WAKE-UP
SLEEP
RSP2
RSP2
RD2
END2
t 0
t 1
t 2
t 3
t 4
t 5
t 6
t 7
TIME

COMMUNICATION SYSTEM FOR VEHICLES

CROSS REFERENCE TO RELATED APPLICATION

This is a continuation of application Ser. No. 08/574,635, filed on Dec. 19, 1995, which was abandoned upon the filing hereof.

BACKGROUND OF THE INVENTION

This application is based upon and claims the benefit of priority of the prior Japanese Patent application No. 6-320208 filed on Dec. 22, 1994, the contents of which are incorporated herein by reference.

1. Field of the Invention

The present invention generally relates to a communication system for vehicles, and more particularly to a communication system for vehicles comprising an aboveground unit for setting a specified communication area on a road and vehicle mounted responders mounted on vehicles for communication with the aboveground unit when the vehicles pass through the communication area.

2. Related Arts

As a method for toll collection designed for a toll road, such as expressway, a system has been conceived which comprises a communication unit (vehicle mounted responder) stored with an identification No., etc. registered beforehand and mounted on the vehicle side and a communication unit (aboveground unit) disposed at a place of toll collection on the road for such an arrangement that when a vehicle passes through a communication area set by the aboveground unit, communication is performed between the aboveground unit and the vehicle mounted responder and thereby the vehicle of the registered identification No. passes through the communication area is recognized and toll is settled based on the recorded data.

The aboveground unit includes an antenna element for communication. In general, the antenna element comprises a plurality of patches on one surface side of a printed circuit board, and each patch is combined with a transmission line for receiving power supply.

In general, when a plurality of patches P are used to form an array antenna, as illustrated in FIG. 23, a main lobe ML and a side lobe SL are generated by the mutual interference of waves outputted from each patch P. When the side lobe SL is generated, an area where the waves drown out each other by the mutual interference thereof, i.e., a dead zone DZ, is generated between the side lobe SL and the main lobe ML.

If the dead zone DZ is generated at the height of the vehicle mounted responder indicated with broken line in this figure, there will be a problem that as the vehicle mounted responder passes through the side lobe SL, the dead zone DA and the main lobe ML in this order, toll collection is repeated, and communication is wastefully performed.

SUMMARY OF THE INVENTION

In view of the above problem, it is the primary object of the present invention to provide a communication system for vehicles which can prevent any repeated toll collection and wasteful communication.

According to the communication system for vehicles of the present invention, the size of the side lobe of the setting communication area is reduced by adjusting the impedance of the power supply route connecting each patch. Therefore, it is possible to set the communication area with a small variation in the height direction while maintaining the length thereof necessary for communication according to each traffic lane width. It is consequently possible to perform communication processing by setting a constant communication area irrespective of the mounting height of the vehicle mounted responder that varies depending on the size of the vehicles in running.

Furthermore, depending on the number and layout of the patches, an appropriate communication area can be set to the requirements of the traffic line width of the road, the height dimension of the installation position of the antenna element and other environment, and hence the degree of freedom can be increased.

It should be noted here that the antenna unit can be so constructed as to have a plurality of antenna elements having the respective communicable areas which differ from each other. If the communication area of the antenna unit is set by setting a communicable area beneath the first antenna element by using the first antenna element and a communication area on the farther side by using the second antenna element, even if a small vehicle exists immediately behind a large vehicle, for example, the dead zone caused to the communication area by the large vehicle can be dissolved when the large vehicle passes through, and communication processing for the small vehicle within the communicable area set by the first antenna element can exactly been performed. As a result, there is a little dead zone due to the condition of the vehicles passing through, and communication processing can exactly been performed.

If a direction adjusting means is provided for adjusting the setting direction of the communication area, when the antenna element is installed, it is possible to fine adjust the setting direction according to the road and the installation position of the antenna element. It is consequently possible to set the communication area to a desired area and increase the degree of freedom of the installation work.

Moreover, if a plurality of antenna units are provided and the adjoining antenna units are so set as to have the respective communication timings and oscillation frequencies which differ from each other, even if the vehicle mounted responder passes through the duplicated area of the communication areas set by the antenna units, for example, the vehicle mounted responder does not concurrently receive interrogatory signals from both antenna units but receives interrogatory signals earlier from either antenna unit, and the vehicle mounted responder that has received the interrogatory signals can perform communication with the antenna unit that has sent the interrogatory signals to the vehicle mounted responder.

Here, if the length dimension of the communication area is set to be or less than approximately the length dimension of the vehicle, even if a plurality of vehicles pass through in the bumper-to-bumper state, as long as it is the normal running state, communication processing can be performed for each vehicle and the occurrence of impossible communication due to interference or the like can be minimized.

If the communication system for vehicles according to the present invention is applied to the toll collecting operation for a toll road, the conventional toll collection operation by hand at tollgates, etc. can be saved, and hence traffic jam at tollgates can be eased and cost reduction can be facilitated by cutting labor or performing speedy toll settlement without using cash.

BRIEF DESCRIPTION OF THE DRAWINGS

These and other objects, features and characteristics of the present invention will be appreciated from a study of the following detailed description, the appended claims, and drawings, all of which form a part of this application. In the drawings:

DETAILED DESCRIPTION OF THE PRESENTLY PREFERRED EXEMPLARY EMBODIMENTS

Now, the first embodiment in which the present invention is applied to a toll collecting operation system at an expressway will be described referring to the appended FIGS. 1 through 22.

Figure 1:
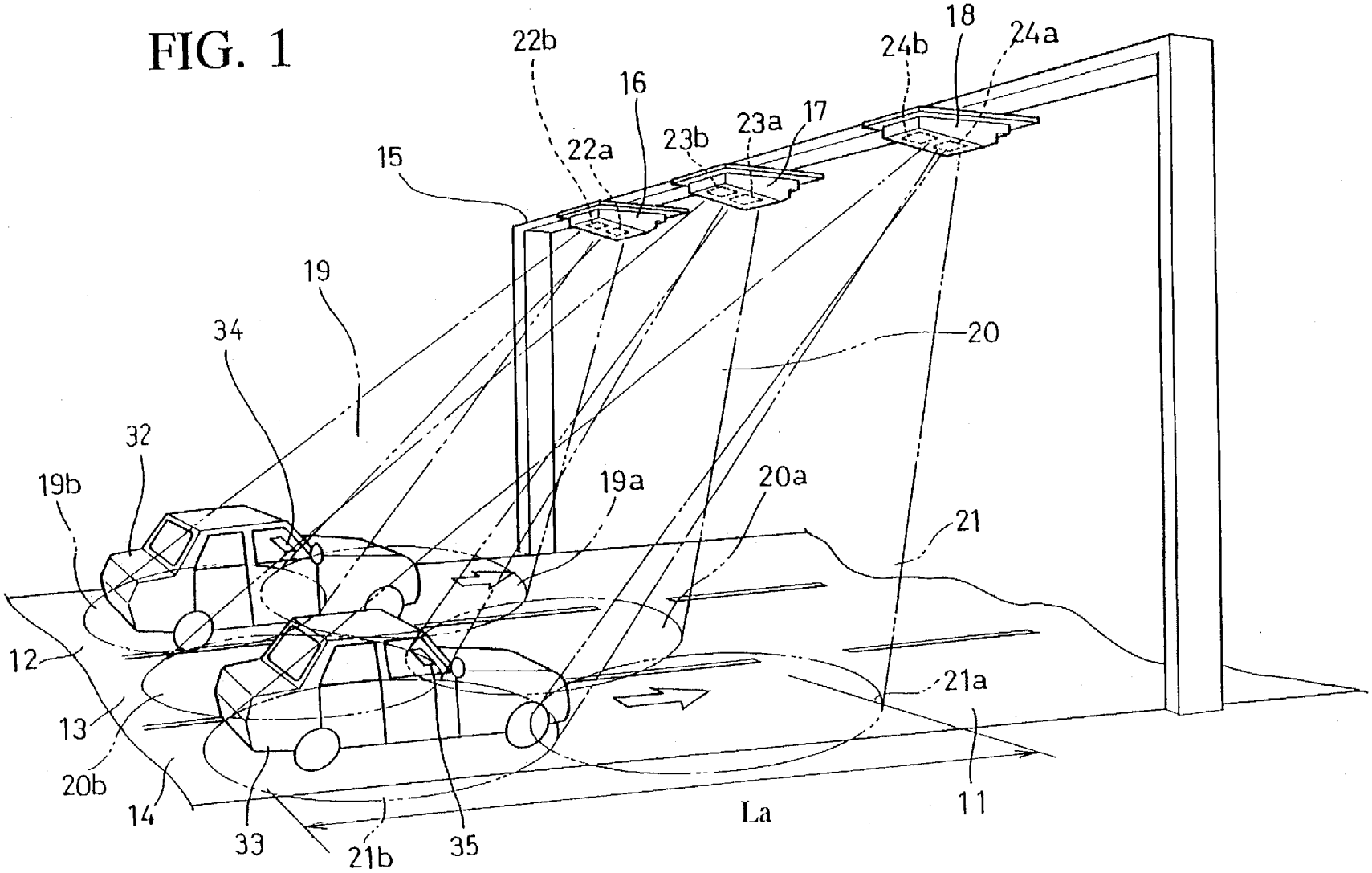
FIG. 1 is a perspective view illustrating the entire construction of a first embodiment according to the present invention.

In FIG. 1 illustrating the entire appearance of the construction of the present invention, an expressway (illustrated the traffic area on one side only) 11 has three traffic lanes 12, 13 and 14 on one side. At a specified toll collecting point is disposed a gantry 15 as an aboveground unit crossing over the expressway 11 as a aboveground unit. On this gantry 15 are downwardly disposed antenna units 16, 17 and 18 to counter traffic lanes 12, 13 and 14 respectively to set communication areas 19, 20 and 21.

The communication areas 19, 20 and 21 are set from the antenna units 16, 17 and 18 to vehicles (e.g., 32 and 33 in FIG. 1) in the approaching direction thereof. The antenna unit 16 is provided with antenna elements 22*a* and 22*b*. The communication area 19 is composed by setting communicable areas 19*a* and 19*b* for these antenna elements 22*a* and 22*b* respectively. In the same way, the antenna unit 17 is provided with antenna elements 23*a* and 23*b*, and communication area 20 is composed by setting communicable areas 20*a* and 20*b* respectively, and the antenna unit 18 is provided with antenna elements 24*a* and 24*b*, and communication area 20 is composed by setting communicable areas 21*a* and 21*b* respectively.

Figure 2:
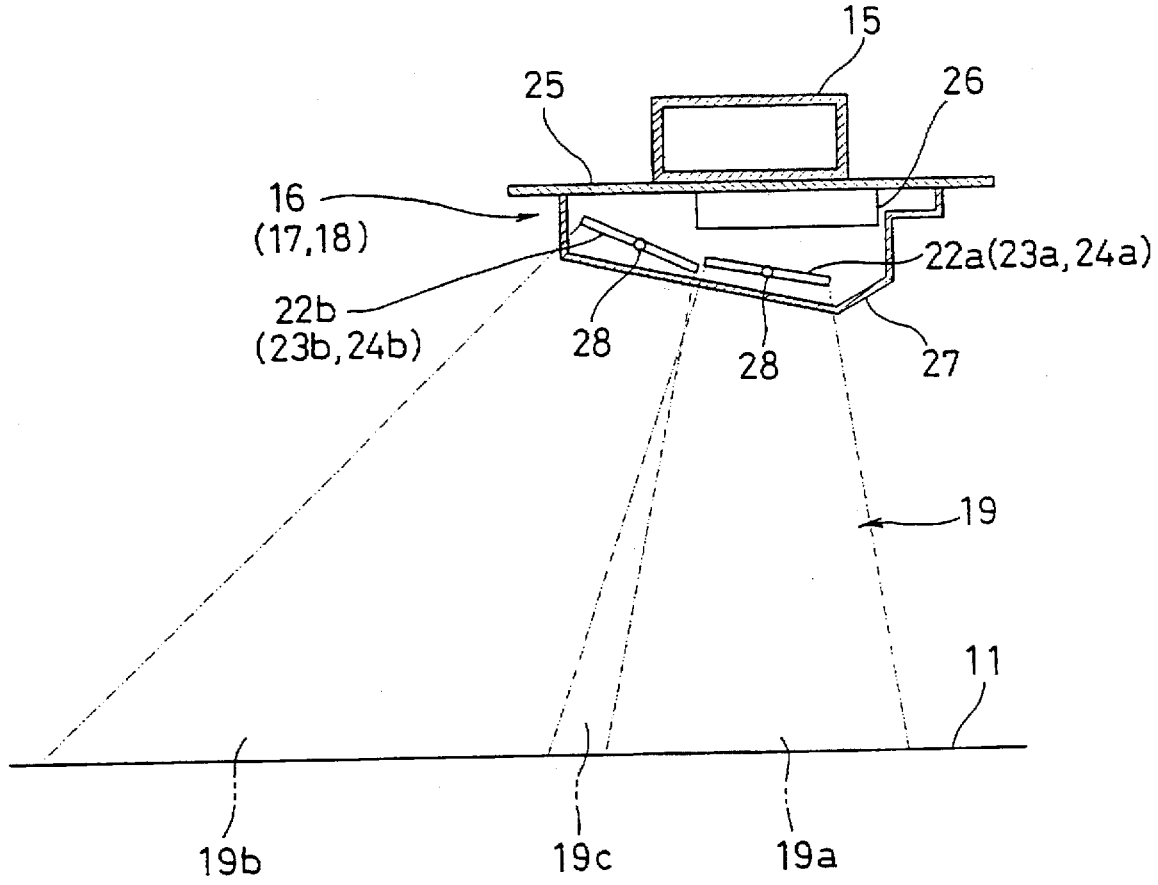
FIG. 2 is a vertical cross-sectional view illustrating an antenna part.
Figure 3:
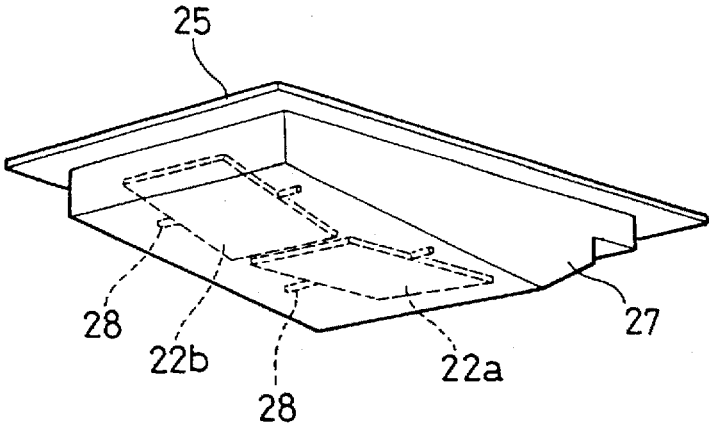
FIG. 3 is a perspective view illustrating the appearance of the antenna unit.

As illustrated in FIGS. 2 and 3, on the antenna units 16, 17 and 18 (although only the antenna unit 16 is illustrated representing all the antenna units in this figure, the rest antenna units are of the same construction) are disposed a control circuit part 26 on a base attached to the bottom surface of the gantry 15, and the antenna elements 22*a* and 22*b*. The entirety is covered with a resin cover 27 which can permeate electric waves to form a waterproofing structure. The control circuit part 26 is provided with an electric circuit (described later) to drive and control the antenna elements 22*a* and 22*b* for performing transmitting and receiving operations.

As illustrated in FIGS. 2 and 3, the antenna elements 22*a* and 22*b* are rotatably supported by supporting rods 28 and 28 respectively as a direction adjusting means in such a way that the directions of the radiation surfaces of the antenna elements 22*a* and 22*b* can be adjusted. The antenna elements 22*a* and 22*b* are also rotatably supported by a well-known structure (not illustrated) in the directions at right angles to the supporting rods 28 and 28 respectively in such a way that the directions of the radiation surfaces of the antenna elements 22*a* and 22*b* can be adjusted in the direction at right angles to the supporting rods 28 and 28 respectively.

Furthermore, according to the angles of the radiation surfaces of the antenna elements 22*a* and 22*b*, the communicable areas 19*a* and 19*b* are set respectively, and by composing these communicable areas 19*a* and 19*b*, the communication area 19 is provided. Between these two communicable areas 19*a* and 19*b*, however, is provided a duplicated area 19*c* to join the communicable areas 19*a* and 19*b* without a break (the other antenna element 23*a*, 23*b*, 24*a* and 24*b* are also provided with duplicated areas 20*c* and 21*c* in the same way). As described later, the antenna elements 22*a* and 22*b* are so arranged as to communicate by outputting microwaves of respective proper frequencies which differ from each other.

Each of the antenna elements 22*a*, 22*b*, 23*a*, 23*b*, 24*a* and 24*b* are microstrip array antenna elements, forming eight pieces of square patches 30*a* through 30*h* on one surface side of a printed circuit board 29 (although only the antenna element 22*a* is illustrated representing all the antenna elements, the rest antenna units are of the same construction) which are combined with transmission lines 31*a*, 31*b* and 31*c* for connection to a power supply terminal 31*d*.

In this case, the printed circuit board 29 is made of resin material printed with a conductor on both surfaces (two-sided printed circuit board), wherein the change in the temperature characteristics of the dielectric constant of this resin material within the working temperature range (e.g., high-temperature range up to approximately 120° C.) is not more than the specified (e.g., not more than 1%). For example, BT resin material or glass epoxy material is used. The eight pieces of patches 30*a* through 30*h* are laid out in two rows, four pieces of patches 30*a* through 30*d* in one row and four pieces of patches 30*e* through 30*h* in the other row, with the respective vertexes facing each other being slightly cut out. These patches 30*a* through 30*h* are formed by being etched together with the transmission lines 31*a* through 31*d*. As a material for the patches 30*a* through 30*h* and the transmission lines 31*a* through 31*d*, aluminum is used. By slightly cutting out the vertexes facing each other, the signals to be transmitted become circularly polarized wave signals. Furthermore, it is so arranged that by laying out the patches 30*a* through 30*h* as described above, a desired communicable area can be obtained. On the other hand, the wire widths of the transmission lines 31*a* and 31*b* are so set as to be higher in impedance than the transmission line 31*c*. As an impedance setting method, a method by reducing the wire widths of the transmission lines 31*a* and 31*b* at the time of etching to be narrower than the wire width of the transmission line 31*c* or a method by trimming the transmission lines 31*a*, 31*b* and 31*c* after etching can be employed.

Figure 14A:
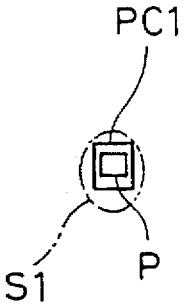
FIGS. 14A through 14E are plan views illustrating the correspondence between the number of patches and communicable area of the antenna element.
Figure 14B:
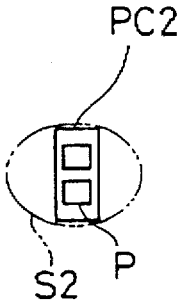
Figure 14C:
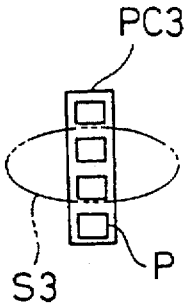
Figure 14D:
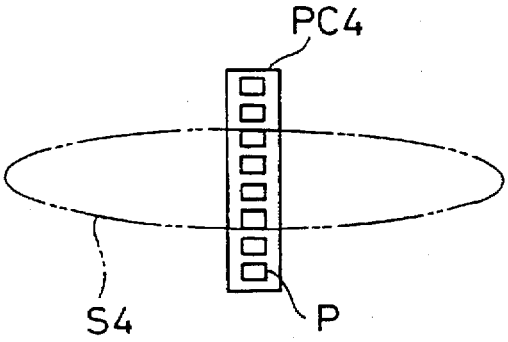
Figure 14E:
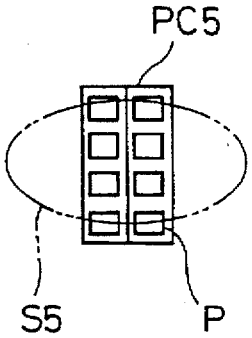
Figure 15A:
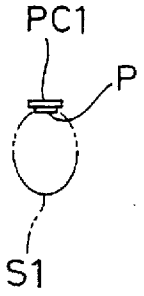
FIGS. 15A through 15E are side views illustrating the correspondence between the number of patches and communicable area of the antenna element.
Figure 15B:
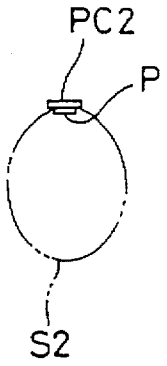
Figure 15C:
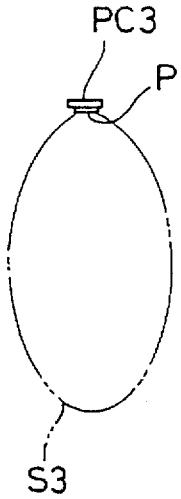
Figure 15D:
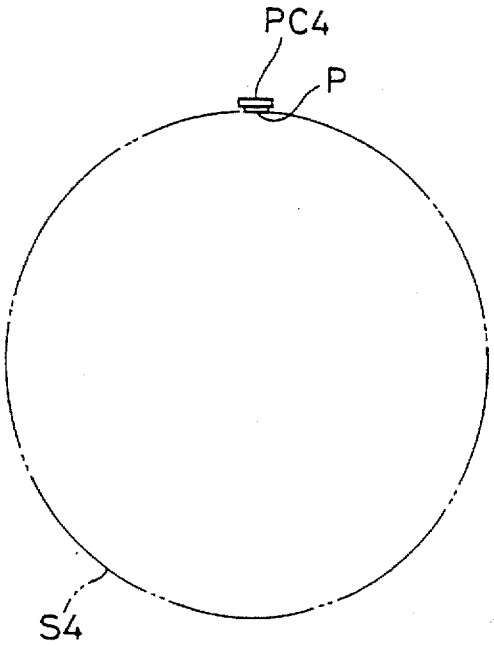
Figure 15E:
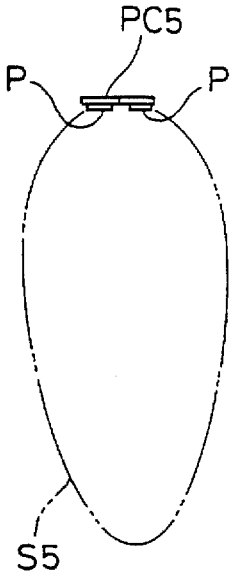

In general, in an array antenna in which a plurality of patches are laid out to set communicable areas, as illustrated in FIGS. 14A through 14E and FIGS. 15A through 15E, the shapes of communicable areas change according to the number of patches P. Specifically, as illustrated in FIGS. 14A through 14D, when the patches P are laid out in a row for one piece, two pieces, three pieces or four pieces, the extensions of communicable areas S1 through S4 become long in the direction at right angles to the row of the patches P, but change little in the direction of the row of the patches P. Furthermore, as illustrated in FIG. 14E, when eight pieces of the patches P are laid out in two rows, four pieces in each row, the communicable area S5 in the row direction becomes wider in comparison with the other layouts. On the other hand, the expansions of the communicable ranges S1 through S4 in the direction of wave radiation reach farther according to the increase in the number of the patches P, as illustrated in FIGS. 14A through 15D. In this case, even when the number of the patches P is eight as illustrated in FIG. 15E, the communicable area S5 reaches almost as far as the illustrated in FIG. 15D.

As described above, by properly selecting the number of the patches P for use in the antenna elements, it is possible to set such communicable areas that have desired shapes, specifically those shapes illustrated in FIGS. 14E and 15E according to this embodiment.

Figure 12:
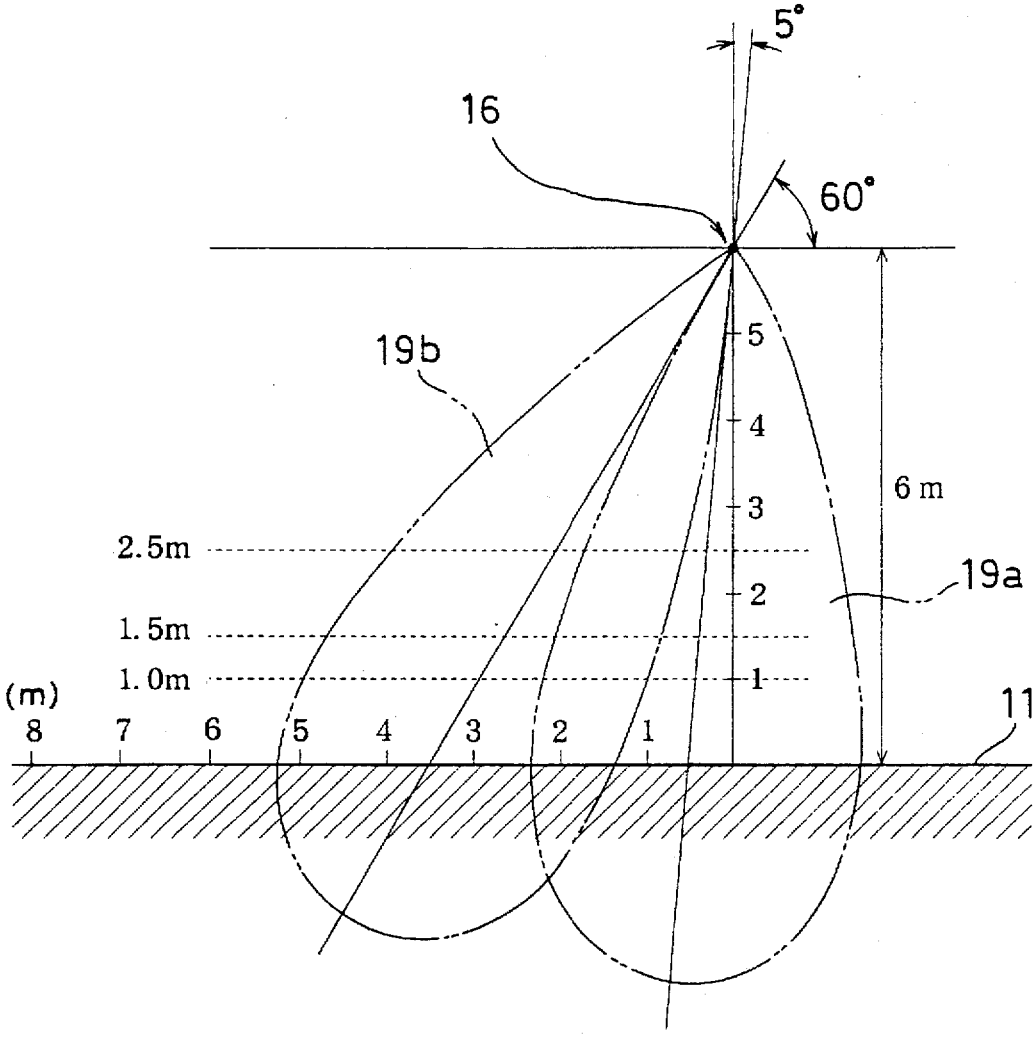
FIG. 12 is a side view illustrating a communication area.

The antenna elements 22*a* and 22*b* according to the present invention are provided with the communicable areas 19*a* and 19*b* respectively as illustrated in FIG. 12. In this FIG. 12, it is assumed that the height for the installation of the antenna unit 16 is 6 m, the antenna element 22*a* providing the communicable area 19*a* beneath the antenna unit 16 is positioned with the angle of the radiation surface thereof inclined by approximately 5° from the vertical direction, while the antenna element 22*b* is positioned with the angle of the radiation surface thereof inclined by approximately 60° from the horizontal direction (approximately 30° from the vertical direction).

Figure 4:
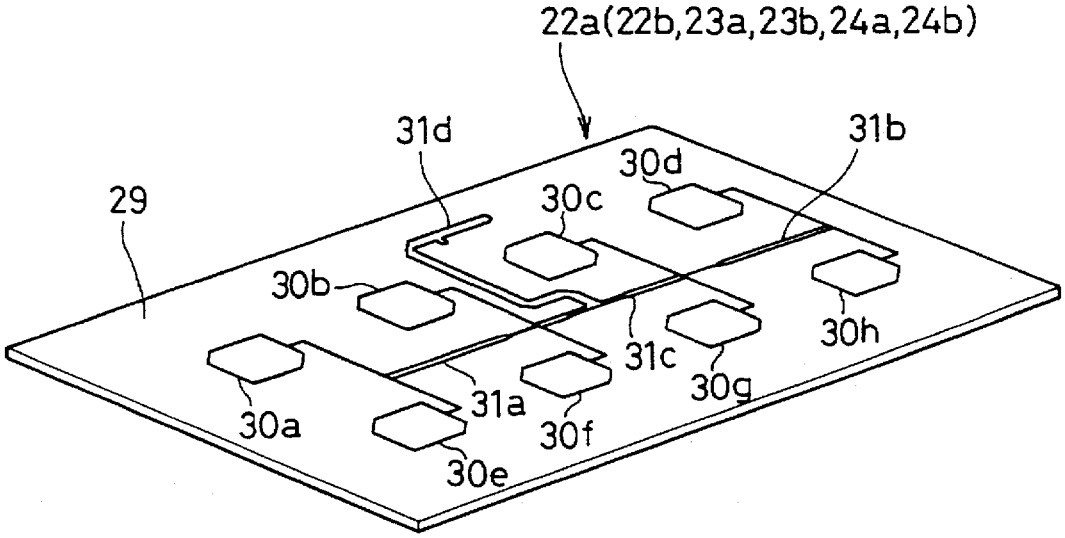
FIG. 4 is a perspective view illustrating the appearance of antenna element.
Figure 5:
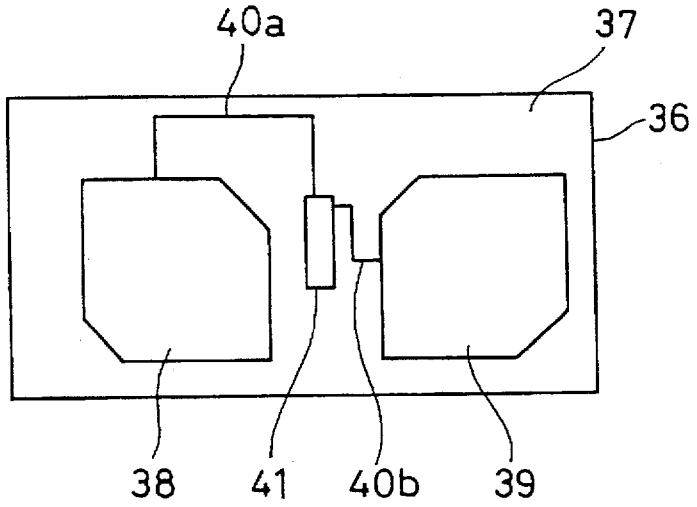
FIG. 5 is a plan view illustrating the antenna element of a vehicle mounted responder.
Figure 16:
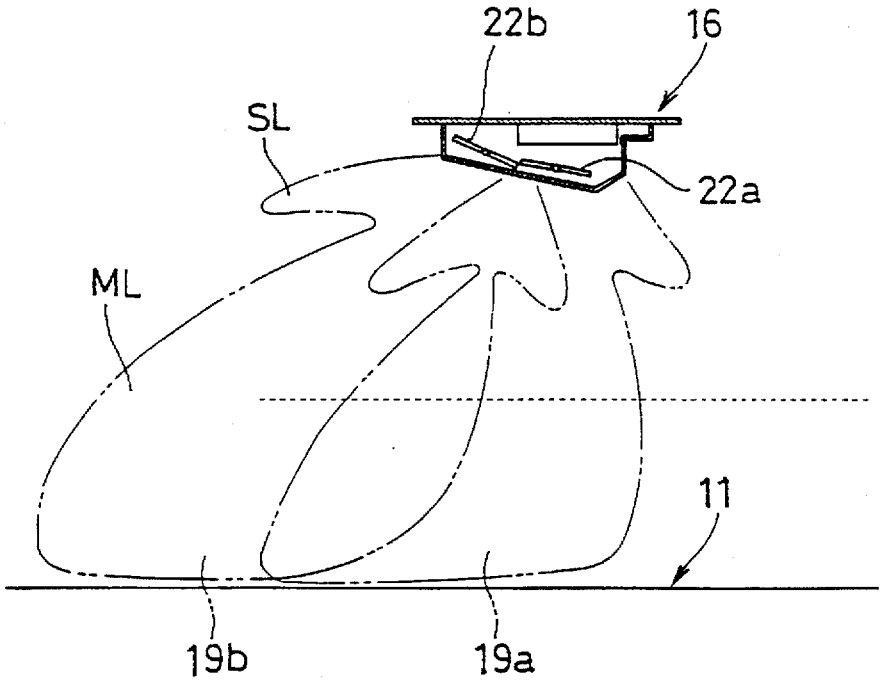
FIG. 16 is a side view illustrating the shapes of the main lobe and side lobe of the antenna unit.
Figure 17:
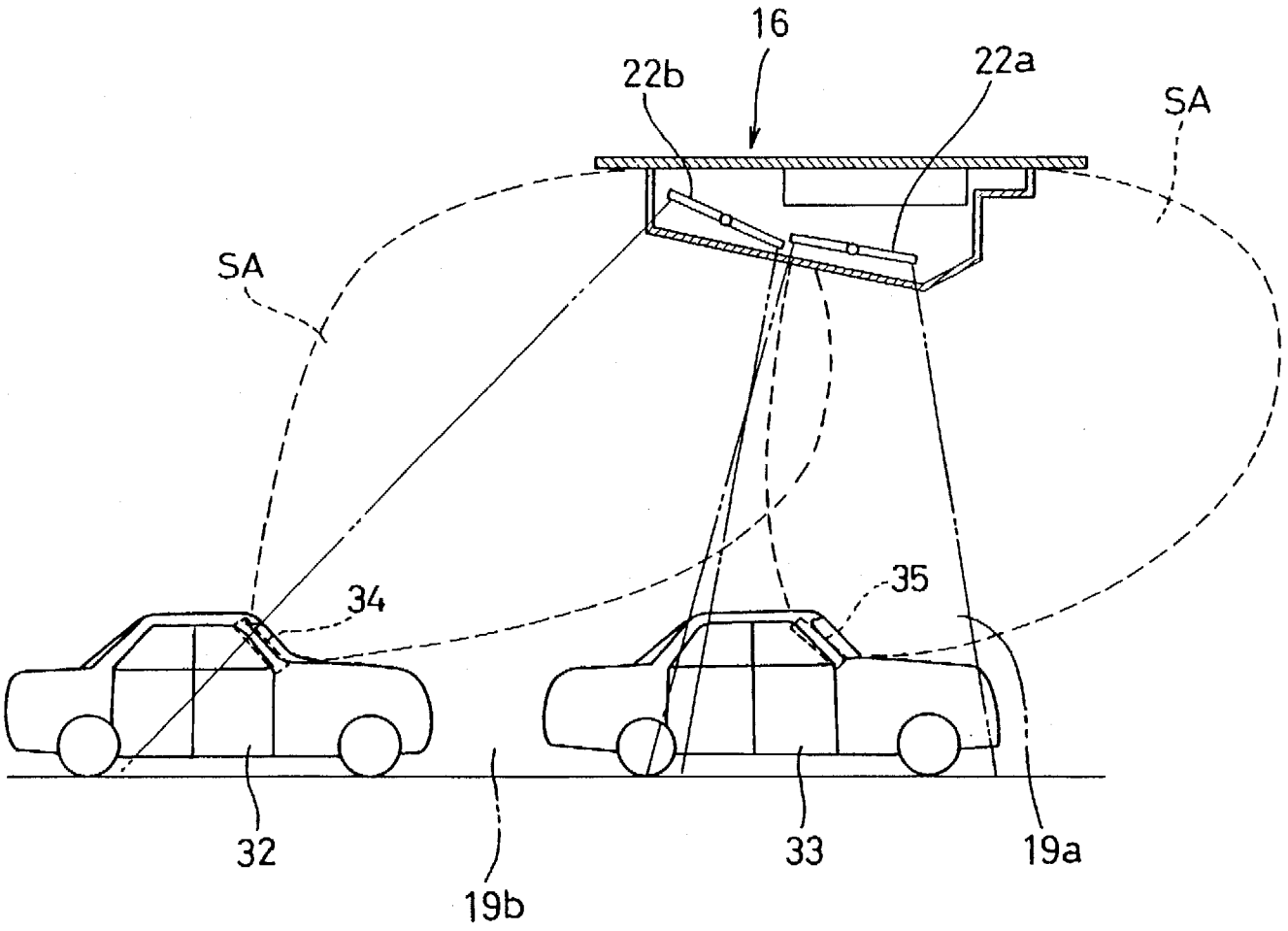
FIG. 17 is a side view illustrating the reaching area of the response signals from the vehicle mounted responder within the communication area of the antenna unit.

Moreover, in the antenna unit 16 (17, 18) of this embodiment, the transmission lines 31*a*, 31*b* and 31*c* to which the eight pieces of patches 30*a* through 30*h* are connected are so set as to be uneven in impedance as illustrated in FIG. 4 against the respective antenna elements 22*a* and 22*b*. As a result of this arrangement, the amplitudes of waves outputted from the patches 30*b*, 30*c*, 30*f* and 30*g* disposed at the central part on the printed circuit board 29 become large, and the amplitudes of waves outputted from the patches 30*a*, 30*d*, 30*e* and 30*h* disposed at the end part become small. Accordingly, as illustrated in FIG. 16, side lobe SL becomes small. Here, in FIG. 16, the broken line indicates a position at which level a responder mounted on a vehicle is supposed to be (e.g., the level of the hood of the vehicle).

Figure 13A:
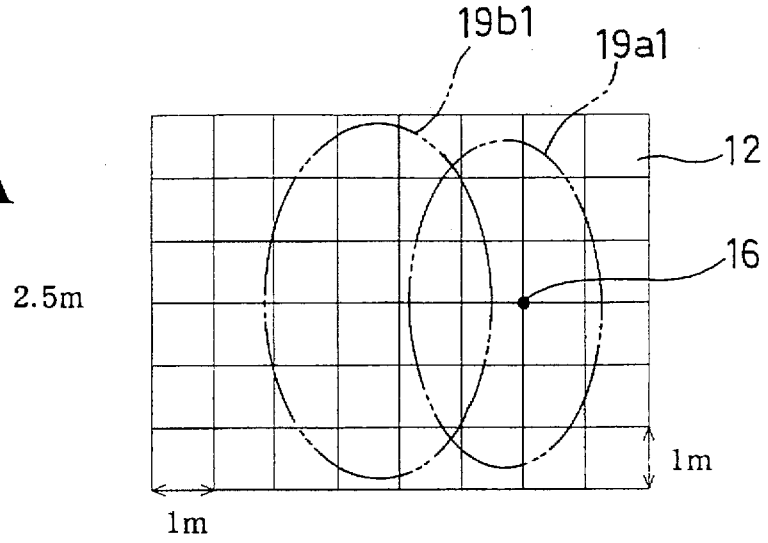
FIGS. 13A through 13C are plan views of the communication area with different height dimensions.
Figure 13B:
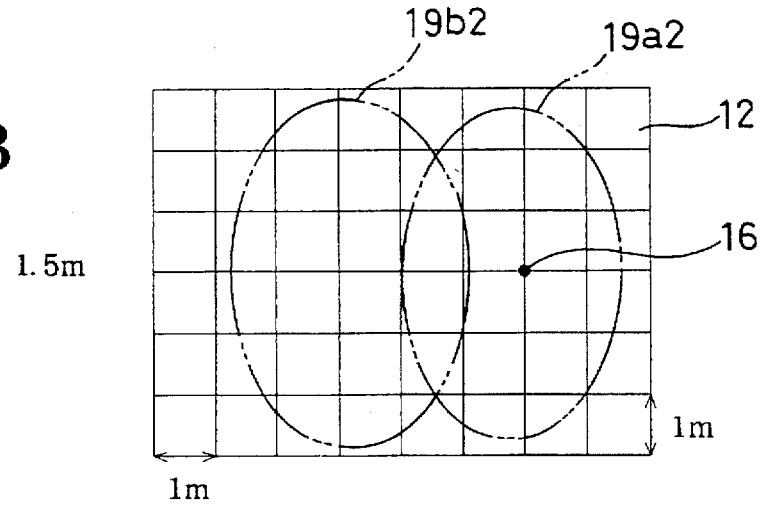
Figure 13C:
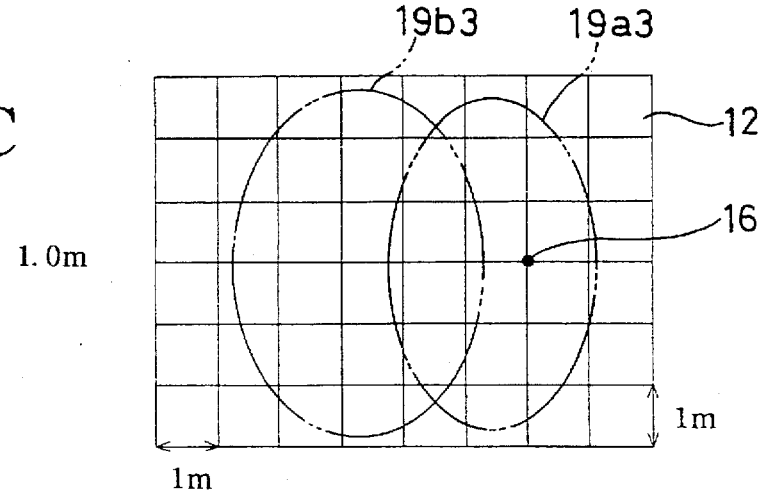

By constructing as described above, in any position of the heights of 2 m, 1.5 m and 1 m, as illustrated in FIGS. 13A, 13B and 13C, communicable areas 19*a*1, 19*a*2 and 19*a*3 and 19*b*1, 19*b*2 and 19*b*3 of almost the same dimensions can be obtained with the communication area 19 to be capable of covering almost the same area even with different heights.

Vehicles (e.g., 32 and 33 in FIG. 1) running on the expressway 11 are mounted with responders 34 and 35 in the vicinity of the respective hoods. Each of these vehicle mounted responders 34 and 35 is provided with the control circuit part 26 (FIG. 2) and an antenna 36 which receives interrogatory signals from the antenna units 16, 17 and 18 on the aboveground unit (gantry) 15. This antenna 36 is an microstrip antenna with square patches 38 and 39 composed on a printed circuit board 37 which is the same as that used for the above-described antenna element 22*a*. In this case, the patches 38 and 39 are composed as a single patch provided for receiving and transmitting waves.

The patches 38 and 39 are formed with the vertexes facing each other cut out to circularly polarize waves, and so composed as to be connected to the power supply point side through transmission lines 40*a* and 40*b* respectively through an amplifier 41. Accordingly, it is so constructed that when the vehicle mounted responders 34 and 35 are within the communication area 19, response is possible within a less directive range SA illustrated in FIG. 17, for example. For the antenna 36, it is so constructed that in transmitting response signals, transmission is performed by modulating unmodulated carrier waves received from the side of the antenna unit 16 by using response signals and reflecting the modulated carrier waves. Specifically, the vehicle mounted responders 34 and 35 receive unmodulated carrier waves from the antenna units 16, 17 and 18 within the communication areas 19, 20 and 21 and reflect the same while receiving the same, and thereby response signals can be transmitted.

Next, the construction of the electric circuit of the control circuit part 26 will be described referring to FIGS. 6 through 11.

Figure 6:
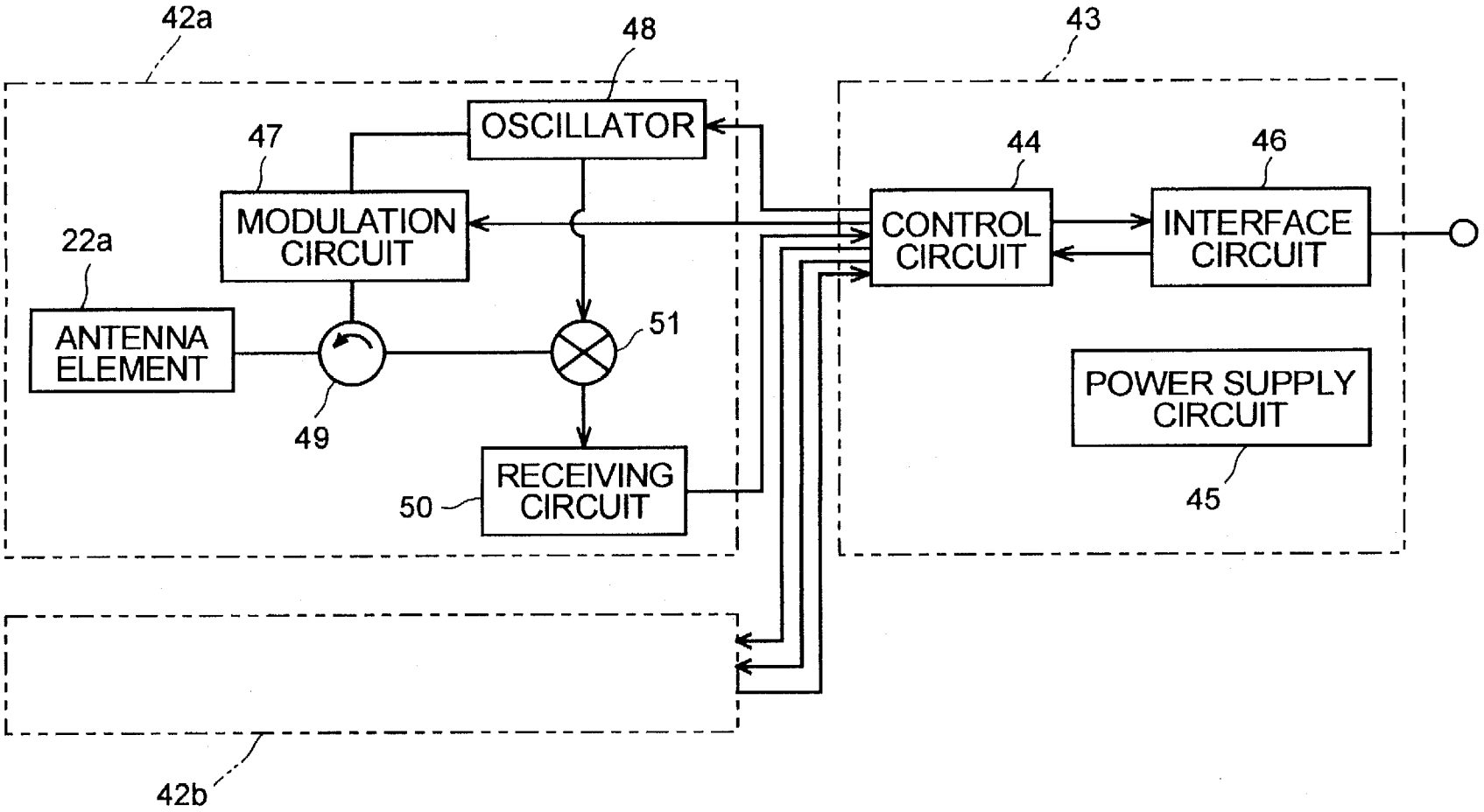
FIG. 6 is a schematic diagram illustrating the electrical construction of the antenna unit.

FIG. 6 illustrates the entire construction. A control part 43 which unifyingly controls control circuits 42*a* and 42*b* of the respective antenna elements 22*a* and 22*b* is composed of a control circuit 44, an electric power circuit 45 and an interface circuit 46 for exchanging data with the outside. Here, in this figure, as the control circuit 42*b* is the same as the control circuit 42*a*, the illustration of the internal composition thereof is omitted. In the control circuits 42*a* and 42*b* provided to counter the antenna elements 22*a* and 22*b* respectively, a modification circuit 47 is so arranged as to take the oscillation output given from an oscillator 48 having a specified frequency as carrier waves and modify the same by using the pilot interrogatory signals or interrogatory signals given from the control circuit 44 and output the same to the antenna element 22 through a circulator 49. Here, the pilot interrogatory signals mean signals which activates a responder mounted on a vehicle and interrogates the type of the vehicle to the responder.

A receiving circuit 50 for processing signals, such as demodulation, is connected to a mixer 51. To the mixer 51 is so arranged as to receive oscillation outputs as carrier waves from the oscillator 48 and also receive wave signals from the antenna element 22*a* through the circulator 49 according to the carrier waves and response signals. The carrier waves and the wave signals according to the response signals are composed together by the mixer 51, and then sent to the receiving circuit 50. The receiving circuit 50 is so arranged to obtain the response signals by demodulating the given composite signals and output the same to the control circuit 44.

The respective oscillators 48 provided to counter the antenna elements 22*a* through 24*b* described above outputs, as carrier waves, quasi-microwaves of 2.45 GHz band, for example, allotted as a specified frequency area, and therefore, are so constructed as to allot and output frequencies f1 through f6 having narrow different frequency areas in the frequency band. On the other hand, as described later, the responder 34 (35) mounted on the vehicle is so provided as to receive the signals corresponding to all the oscillation frequencies f1 through f6 of the respective oscillator 48.

The antenna units 16, 17 and 18 constructed as described above are so arranged as to receive timing signals which drive the antenna units 16, 17 and 18 in correspondence to the antenna elements 22*a* through 24*b* respectively from a controller (not illustrated) to which the antenna units 16, 17 and 18 are connected through the interface circuit 46. Here, the output timing of pilot interrogatory signals and interrogatory signals to the communication areas 18, 20 and 21 is so set as to have time-lag of a half cycle from each other between the adjoining antenna units 16 and 17 and between the adjoining antenna units 17 and 18. By this arrangement, even if the vehicle mounted responder 34 (35) passing through the communication area 19, 20 or 21 passes through the duplicate area of the communication areas 19 and 20, for example, it is so arranged that the responder 34 (35) does not concurrently receive pilot interrogatory signals from the two antenna units 16 and 17.

Figure 7:
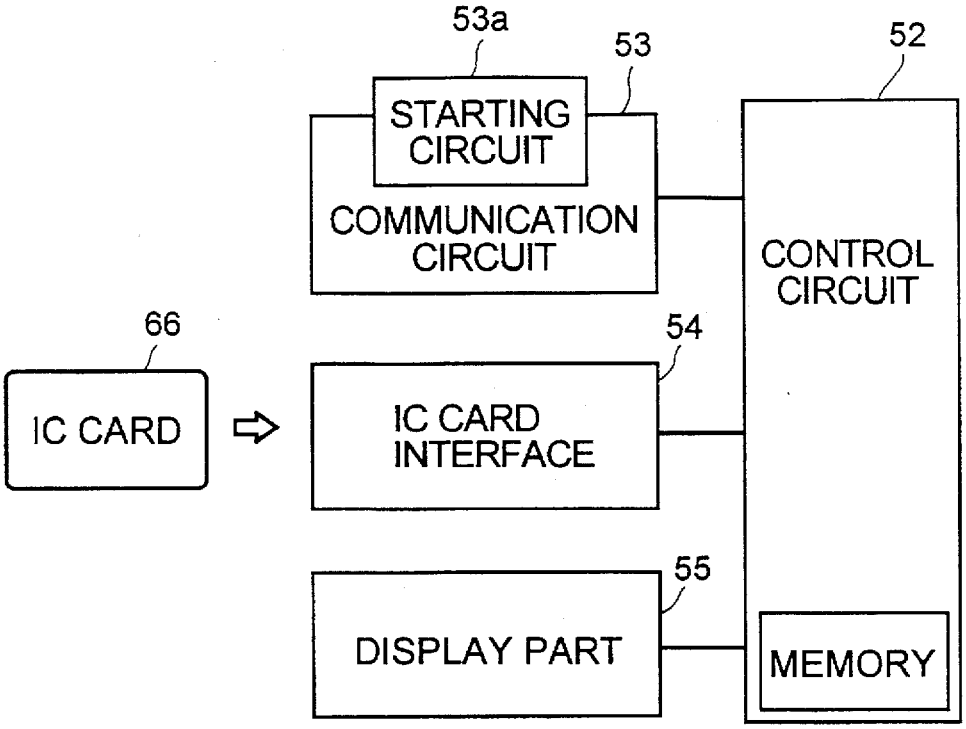
FIG. 7 is a schematic diagram illustrating the electrical construction of the vehicle mounted responder.
Figure 8:
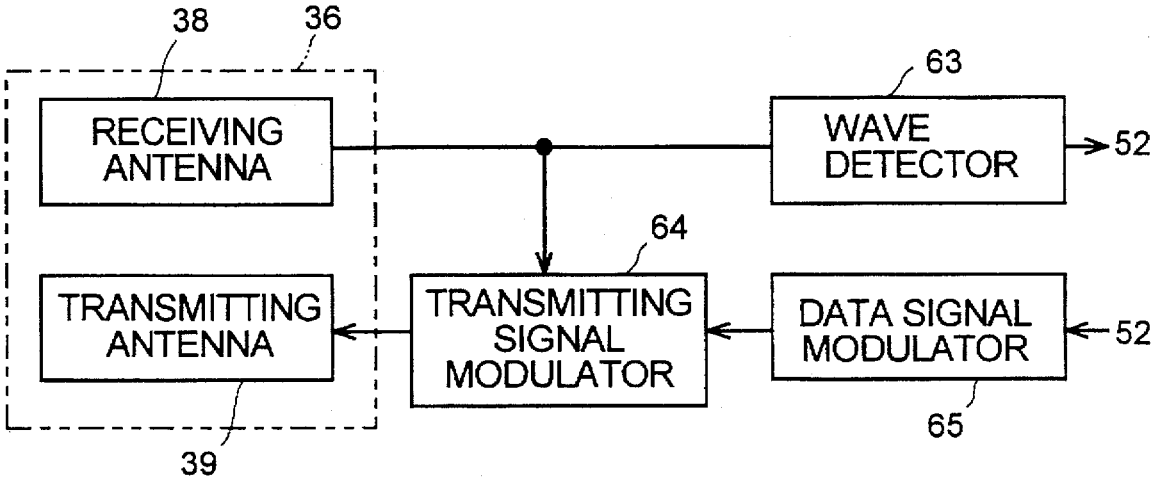
FIG. 8 is a schematic diagram illustrating the electrical construction of the communication circuit of the vehicle mounted responder.

In FIGS. 7 and 8 illustrating the electrical construction of the control circuit part of the vehicle mounted responder 34 (35), a control circuit 52 for controlling the entirety is composed of a microcomputer, a ROM, a RAM, etc. and has been stored with a communication program for entire communication control. On the vehicle mounted responder 34 are disposed a communication circuit 53, an IC card interface 54 and a display part 55 for displaying the communication state.

The communication circuit 53, which is designed to process the transmitting and receiving of signals by the above-described antenna 36, is added with a starting circuit 53*a* which is so constructed as to start the entire system upon the receipt of pilot interrogatory signals. That is, when communication is not performed, most components including the control circuit 52 are in the inactive state, i.e., "sleep state," but activated by this starting circuit 53*a* into the communicable state, i.e., "wake-up state."

As illustrated in FIG. 8, the communication circuit 53 is so connected that receiving signals can be given from the receiving antenna 38 to a wave detector 63 and a transmitting signal modulator 64 and the wave detector 63 can wave detect receiving signals and output the same to the control circuit 52. A data signal modulation circuit 65 is so constructed that, upon the receipt of transmitting data signals from the control circuit 52, frequency modulate or phase modulate the transmitting data signals and send the same to the transmitting signal modulation circuit 64. The transmitting signal modulation circuit 64 is so constructed as to modulate the carrier wave signals received by the receiving antenna 38 by using modulation signals generated by the data signal modulation circuit 65 and output the same as transmitting wave signals through the transmitting antenna 39.

In the above case, the control circuit 52 is so arranged as to set the transmission timing of the data to be sent by selecting a time slot at random from among a plurality of preset time slots and using the selected time slot as described later. That is, it is so arranged that even if transmitting signals from a plurality of vehicle mounted responders 35 (45) compete with each other, differentiation in time slot can prevent the concurrent transmission of transmitting signals and consequently prevent the occurrence of interference.

The IC card interface 54 is designed for use with the installation of an IC card 66, which has been registered for each user (person) or vehicle, and can be installed into the IC card interface 54. The IC card 66 has stored various data including the registered identification code, built in with a write enable storing means, and is so constructed as to exchange various data including toll collection data through the IC card interface 54.

Now, description will be given to the length dimension La of the communication areas 19, 20 and 21 referring to FIG. 1. When the vehicle mounted responder 34 passes through the communication area 19, 20 or 21, an exact communication with the vehicle mounted responder 34 must be secured. As the minimum requirement, the length dimension La along the forward direction of the expressway 11 must be set for a certain length or more to prevent the vehicles from straying from the communication areas 19, 20 and 21 during the communication.

Firstly, the requirements of the length dimension La of the communication areas 19, 20 and 21 are set by using the following equation:

$$La>(C/S+t)\times V\times n \quad (1)$$

where, C is data information content (byte), S is communication speed (byte/sec), t is information processing speed within the system (sec), V is vehicle speed (m/sec), and n is the number of retransmission specified as the number of communication necessary for one toll collection data exchange.

When calculation is made for a case with a vehicle speed of 120 km/h, an information content of 150 bytes, a data processing speed of 10 ms, and a communication speed of 100K bytes, and the number of communication of 3 by using the above equation, it is found that the length dimension La necessary for the communication area 19, 20 and 21 should be 2.2 m or longer.

To arrange the vehicle speed to be compatible to higher speed, the length dimension La of the communication areas 19, 20 and 21 must be increased according to the above equation. If the length dimension La becomes too long, it is likely that a plurality of vehicle mounted responders 34 (35) concurrently enter the communication areas 19, 20 and 21, and therefore a problem is that interference may occur at a high probability. Therefore, the value of the length dimension La should preferably be maintained shorter than the length of the smallest vehicle among of all the vehicles.

In view of the above, in order to compatible to high-speed vehicles, it is preferable that the communication speed S should be set to a larger value instead of setting the length dimension La of the communication areas 19, 20 and 21 to a larger value. Therefore, the principle for increasing the communication speed S will be briefed now.

Figure 11:
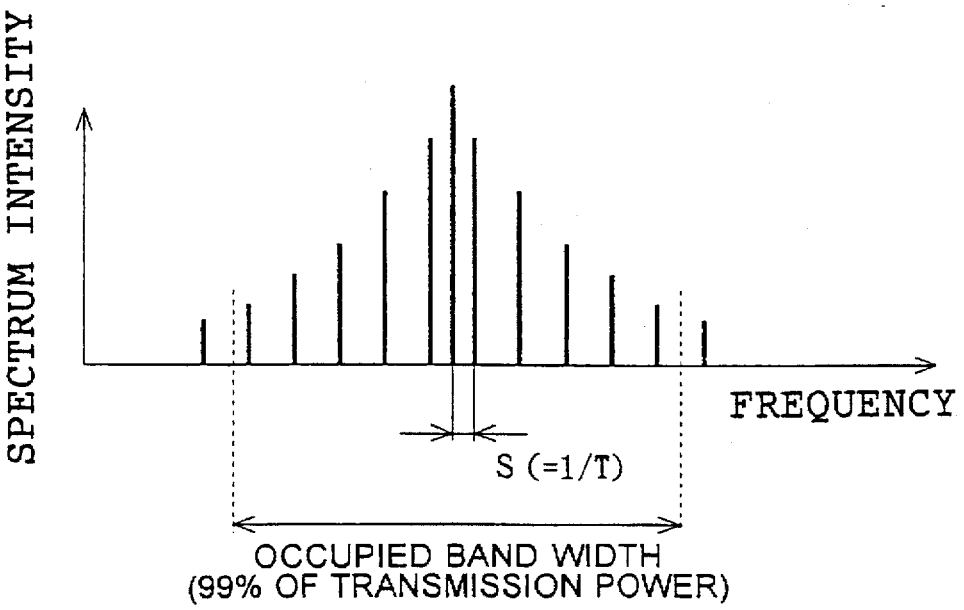
FIG. 11 is a frequency characteristic diagram illustrating the signal output of the antenna element.

Communication between the vehicle mounted responder 35 and the aboveground unit (gantry) 15 is performed by modulating the unmodulated carrier waves received from the aboveground unit 15 and transmitting the response signals to the side of the aboveground unit 15 while reflecting on the side of the vehicle mounted responder 34. Here, the communication speed S is determined according to the occupied bandwidth of the modulated waves (modulated signals) of all the transmitting signals. The occupied bandwidth of the electric power obtained from the spectra of the transmitting signals can be calculated by obtaining the size of the spectrum width that occupies 99% of the entire sending power. FIG. 11 typically illustrates modulated signals and the spectra. The electric power percentage Kn (n=1, 3, 5, . . . ) when the spectra of the modulated signals are taken for n pieces can be expressed by the following equation:

$$Kn = \frac{\frac{1}{2} + \left(\frac{2}{\pi\psi}\right)^2 \sum_{n=1}^{\frac{n+1}{2}} \frac{\sin^2(2n-1)\psi}{(2n-1)^4}}{1 - \frac{2\psi}{3\pi}} \quad (2)$$

Figure 10:
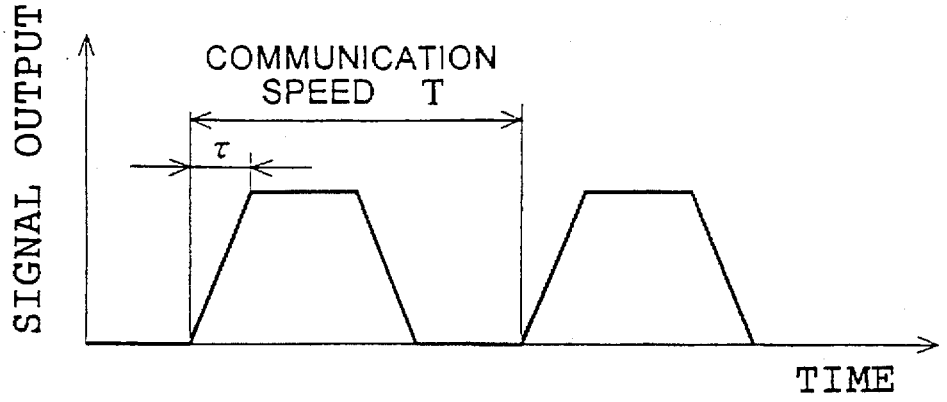
FIG. 10 is a waveform diagram illustrating the signal output waveform of the antenna element.

In the above equation, when the modulated signal rise time is $\tau$, the modulated signal tilt rate can be expressed as $2\tau/S$, and the value obtained by multiplying the modulated signal tilt rate by $\pi$ is $\psi$ ($=2\pi\tau/S$). Therefore, when the modulated signal tilt rate is 0.3, for example, the value of $\psi$ is $0.03\pi$, and K9=98.9% can be obtained and then K11= 99.3% is obtained from the equation (2). From these results, the occupied bandwidth can be formed by taking the spectra up to the eleventh. When the communication frequency band is supposed to be 2.5 MHz, for example, the maximum communication speed can be set to 114 kbps. As communication speed raising methods, there are methods by setting the communication frequency band to a larger value, setting the modulated signal tilt rate to a larger rate, etc. Specifically, by setting the rising time $\tau$ of modulated signals from the antenna element, illustrated in FIG. 10, is set to a larger value, the communication speed can be increased.

Here, according to this embodiment, the frequency of the carrier waves in use is set to the area of 2.45 GHz and the available frequency band is set to 26 MHz. This available frequency band is divided into 12 channels, and 2.17 MHz is allotted to each channel as the communication frequency band. By modulating this by using a modulated signal with a modulated signal tilt rate of 0.03, a communication speed of 100 kbps could be obtained.

Figure 9:
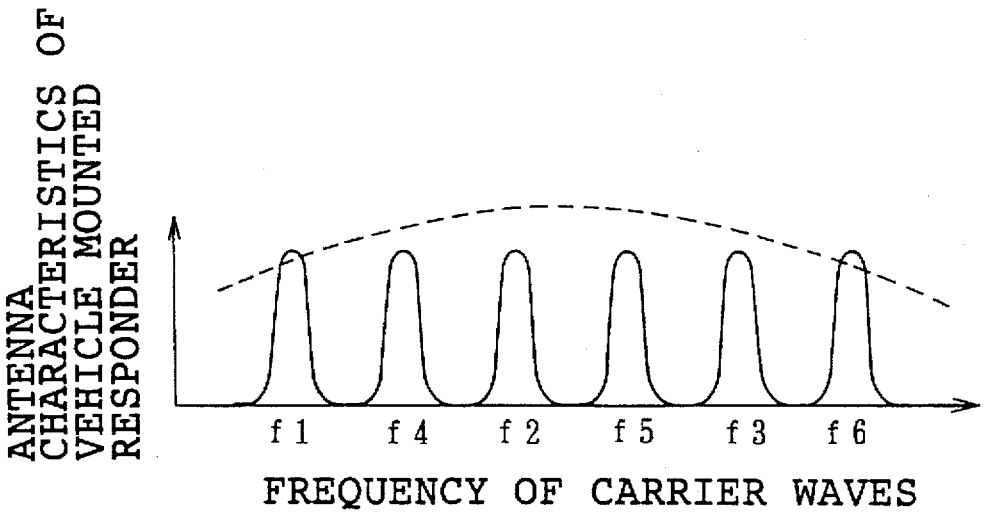
FIG. 9 is a diagram illustrating the carrier wave frequency of the antenna element and the antenna characteristics of the vehicle mounted responder.

Accordingly, 12 pieces of antenna elements were prepared, and each communication frequency was set to 2451±(n×2.17) MHz. Here, n is an integral number from among 1 through 6. Two pieces of antenna elements with the frequencies set in this way are installed in the respective antenna units 16, 17 and 18. To be more specific, different frequencies f1 through f6 are allocated to the respective antenna elements 22*a* through 24*b* of the respective antenna units 16, 17 and 18, and allocated these antenna elements 22*a* through 24*b* to the gantry 15. The antenna characteristics of the vehicle mounted responders 34 and 35 with the respective carrier wave frequencies f1 through f6 within the occupied bandwidth are as illustrated in FIG. 9. In order in this construction to be compatible to a case where the maximum vehicle speed is 120 km/h, the information content is 150 bytes, the data processing time is 12 ms, and the number of retransmission is 3, the value of the length dimension La is set to 3 m.

Furthermore, to set the communicable length dimension La, a two-sided printed circuit board of BT resin with a dielectric constant of 3.7 was employed as the printed circuit board 29, and the patches 30*a* through 30*h* were set to 30 mm in side. Then, the output from each antenna element was set to 20 mW, and the transmission time interval of pilot interrogatory signals was set to 10 ms. By these settings, when each vehicle 32 running on the expressway 11 passes through the communication area 19, 20 or 21, either the antenna unit 16, 17 or 18 can exactly communicate with the responder 34 mounted on the vehicle 32.

This time, the mode of operation of the present invention will be described. In the normal case, as it is assumed that each vehicle separately runs in either traffic lane 12, 13 or 14, it is possible that communication processing is performed with the responder 34 mounted on vehicle passing through the communication area 19, 20 or 21 and the toll can exactly be collected from each vehicle in the same way as the conventional methods.

Figure 18:
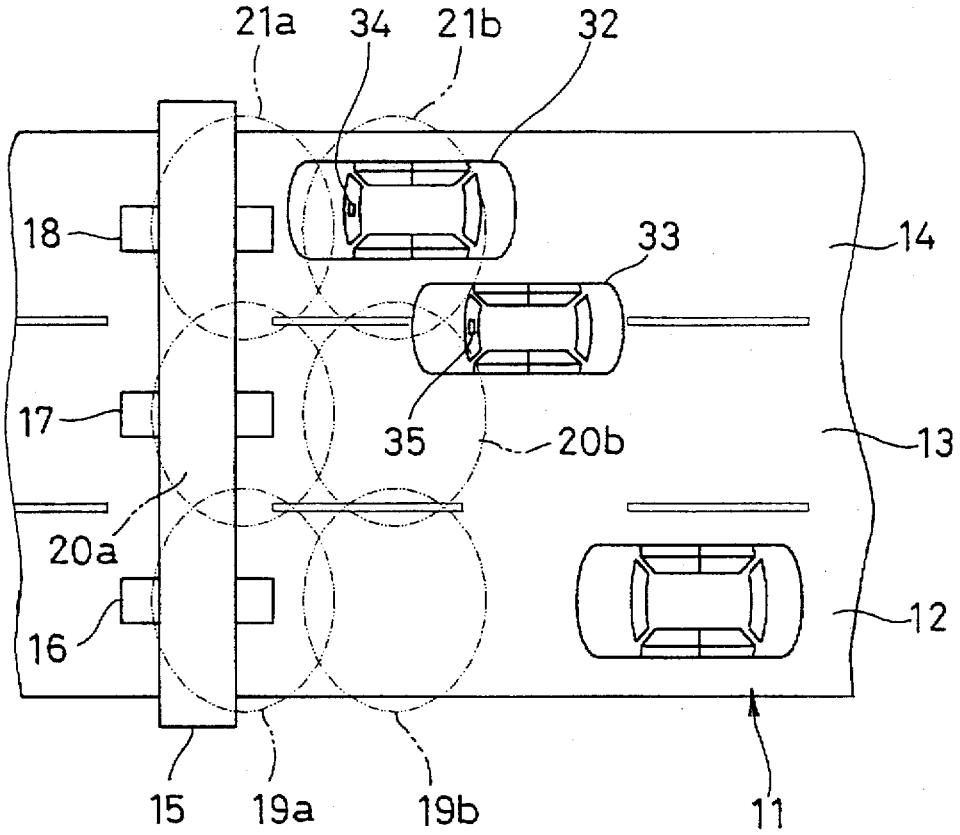
FIG. 18 is a view for use in description of a case where two vehicle mounted responders concurrently exist within the same communication area.

In the following passages, referring to a situation in which interference has conventionally been anticipated, how the communication can exactly been performed even in such situation will be described. As illustrated in FIG. 18, two units of the vehicles 32 and 33 are almost concurrently entering the same communication area 21 of the antenna unit 18, and hence the antenna unit 18 is now capable of communicating with the responders 34 and 35 mounted on the respective vehicles 32 and 33. In this case, it is assumed that the vehicle 33 passes through the duplicated communication area duplicated with the communication area 20 of the antenna unit 17.

In the above situation, as a mode of communication, a case as illustrated in one of FIGS. 19A through 19E and FIGS. 20A through 20E occurs. Specifically, in FIGS. 19A through 19C, the antenna units 16 and 18 are repetitively outputting pilot interrogatory signals at a time interval of $\Delta t$ from a time t0 to a time t7. The antenna unit 17, however, against the adjoining antenna units 16 and 18 in the same timespan, is repetitively outputting pilot interrogatory signals in the same way but at a time interval of $\Delta t$ with a time-lag of $\Delta t/2$.

Figures 19A, 19B, 19C, 19D, 19E:
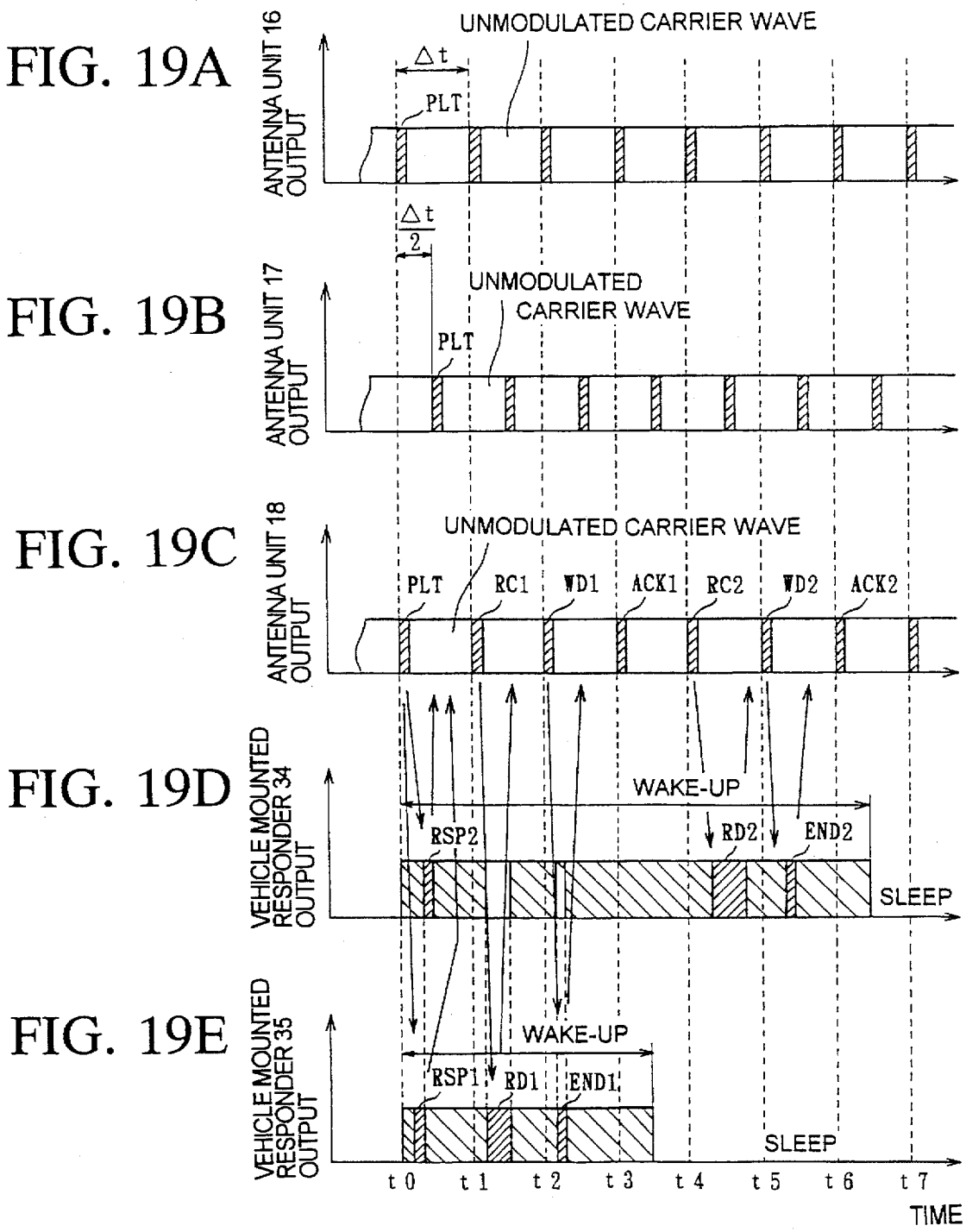
FIGS. 19A through 19E are timecharts illustrating output from three antenna units and two vehicle mounted responders (part I)
Figures 20A, 20B, 20C, 20D, 20E:
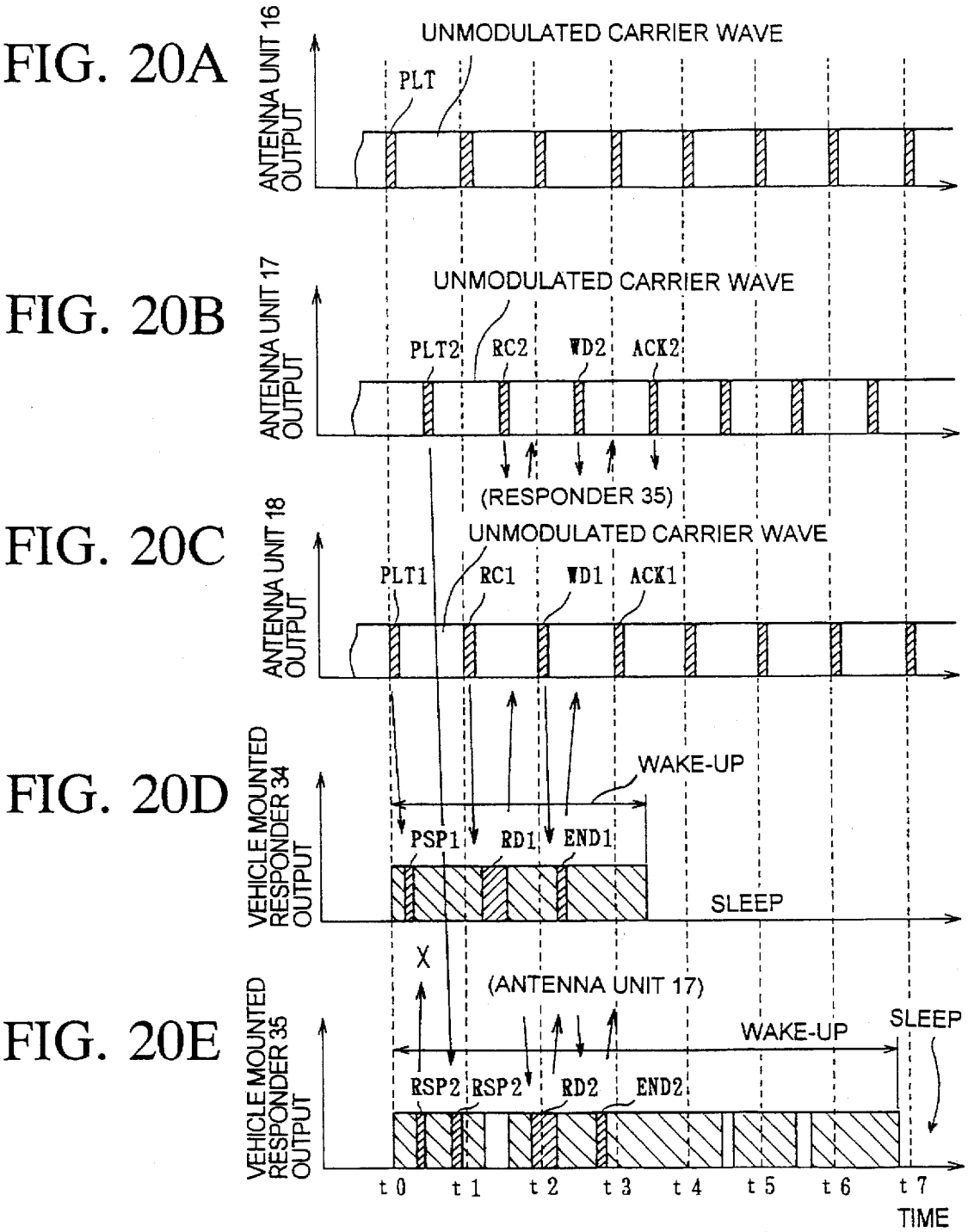
FIGS. 20A through 20E are timecharts illustrating output from three antenna units and two vehicle mounted responders (part II)

Then, as illustrate in FIGS. 19D and 19E, when the vehicle mounted responders 34 and 35 receive pilot interrogatory signals PLT from the antenna unit 18 (time t0), the respective vehicle mounted responders 34 and 35 are switched from the sleep state to the wake-up state by the starting circuit 53*a*, start communication processing operation, recognize and store the place indicating code and gantry code No. contained in the pilot interrogatory signals PLT, and then, as described above, generate the respective response signals RSP1 and RSP2 respectively and transmit the same. In this case, it is so arranged in transmitting the response signals RSP, the unmodulated carrier waves received from the antenna unit 18 are modulated by the response signals into transmitting waves and reflected as described above.

The response signals RSP1 and RSP2 contain the respective identification codes registered in the respective IC cards 66 installed into the respective IC card interface 54. The transmission timings of the response signals RSP1 and RSP2 are so arranged to be set to the respective time slots selected at random respectively from among a plurality number of time slots. Therefore, even if the response signals RSP are concurrently sent from a plurality of vehicle mounted responders 34 and 35, the probability that those transmission timings are duplicated can be lowered, and the opportunities of the occurrence of impossible communication due to interference can be lessened.

In FIGS. 19A through 19E, as the transmission signals from the vehicle mounted responder 35 enters the time slot of earlier transmission timing than the transmission timing of the transmission signals from the vehicle mounted responder 34, the antenna unit 18 determines the receiving order for the response signals RSP1 and RSP2 in such a way that the vehicle mounted responder 35 is the first and the vehicle mounted responder 34 is the second. The antenna unit 18 sends vehicle mounted responder information transmission requesting signals RC1 as interrogatory signals to the vehicle mounted responder 35 (time t1). The vehicle mounted responder information transmission requesting signals RC1 contain the position indicating code, the gantry code No. and the identification code registered in the IC card 66 of the subject vehicle mounted responder 35. When the vehicle mounted responders 34 and 35 receive the vehicle mounted responder information transmission requesting signals RC1, the vehicle mounted responder 35 performs receiving operation, but the vehicle mounted responder 34 determines that the vehicle mounted responder information transmission requesting signals RC1 are not intended thereto due to discrepancy in the identification code and does not perform communication processing.

Upon receiving the vehicle mounted responder information transmission requesting signals RC1, the vehicle mounted responder 35 reads the IC card identification code, the balance amount data and other data from the IC card 66 according thereto, generates card read signals RD1, and transmits the same to the antenna unit 18 in the same way as described above. Then, upon receiving the card read signals RD1, the antenna unit 18 sends a specified data for toll collection data processing as card write signals WD1 to the vehicle mounted responder 35 (time t2). In this case, the card write signals WD1 contain the toll collection order code, the toll data, the position code No., the gantry code No., the identification code of the vehicle mounted responder 35, the operation time data, etc. If the response signals RSP from the vehicle mounted responder 35 are abnormal, the antenna unit 18 is so arranged to perform a specified troubleshooting routine.

Upon receiving the card write signals WD1, the vehicle mounted responder 35 reads the contents thereof and performs a specified write processing. Then, the vehicle mounted responder 35 sends write end signals END1 containing the gantry code No. and the identification code of the vehicle mounted responder 35 to the antenna unit 18 in the same way as described above. Upon receiving the write end signals END1, the antenna unit 18 sends end acknowledge signals ACK1 to the vehicle mounted responder 35 to inform of the receipt of the write end signals END1. Upon receiving the end acknowledge signals ACK1, the vehicle mounted responder 35 determines that the communication has been completed and shifts to the sleep state when the starting circuit 53*a* stops.

Here, the vehicle mounted responders 34 and 35 are so arranged that even if the vehicle mounted responders 34 and 35 receive the pilot interrogatory signals PLT again within the communication area 19, 20 or 21, if the communication processing has already been completed, the vehicle mounted responders 34 and 35 determine the completion of communication processing referring to the communication results stored therein and neglect the pilot interrogatory signals PLT. Hence the communication by any other vehicle mounted responder is protected from interference. This also prevents any duplicated communication within the same communication area 21 or the communication area 19, 20 or 21 of the same gantry 15.

In actual processing for toll collection, it is so arranged that after passing through the communication area 18, the vehicle mounted responder 35 (34) writes the data corresponding to the toll balance less the toll data just communicated and transmitted based on various write data specified by the above-described write signals WD1 into the IC card 66 through the IC card interface 54.

Next, the antenna unit 18 sends the vehicle mounted responder information transmission requesting signals RC1 to the vehicle mounted responder 34, which is determined as the second in the communication order, in the same way as described above, and starts the communication with the vehicle mounted responder 34. When the antenna unit 18 sequentially sends card write signals WD2 and end acknowledge signals ACK2 and performs communication with the vehicle mounted responder 34 to complete communication processing, the vehicle mounted responder 34 also shifts to the sleep state. As a result, even if both the two vehicle mounted responders 34 and 35 almost concurrently enter the communication area 21 of the antenna unit 18, communication can exactly be performed between the antenna unit 18 and both the vehicle mounted responders 34 and 35. Here, it is so arranged that as long as the vehicles 32 and 33 on which the responders 34 and 35 are mounted respectively keep running at normal speeds, communication processing can sufficiently be completed before the vehicles 32 and 33 exit the communication area 21.

In the above case, the two vehicle mounted responders 34 and 35 sequentially perform communication processing against the one antenna unit 18. As the vehicle mounted responder 35 passes through the duplicated area duplicated with the adjoining communication area 20, however, depending on the timing of signal receiving, the vehicle mounted responder 35 can receive pilot interrogatory signals from the antenna unit 17 and communicate with the antenna unit 17. FIGS. 20A through 20E illustrate the contents of such communication processing, and this will be described below.

In this case, the vehicle mounted responders 34 and 35 concurrently receive the pilot interrogatory signals PLT from the antenna unit 18 and send the pilot response signals RSP with different time slots. As the vehicle mounted responder 34 makes such transmission with an earlier timing, however, the vehicle mounted responder 34 becomes the first and the vehicle mounted responder 35 becomes the second in the communication order with the antenna unit 18. Therefore, when the vehicle mounted responders 34 and 35 send the response signals RSP1 and RSP2 respectively, the vehicle mounted responder 35 subsequently receives the pilot interrogatory signals PLT from the antenna unit 17.

The vehicle mounted responders 34 and 35 fix the communication object at the time of receiving the interrogatory signals after sending the response signals RSP1 and RSP2 respectively. Without such interrogatory signals, however, the vehicle mounted responders 34 and 35 are so arranged as to repetitively send the response signals RSP in response to the pilot interrogatory signals PLT. In this case, as the vehicle mounted responder 35 is determined to be the second in the communication order at the antenna unit 18, interrogatory signals to be sent from the antenna unit 18 to the vehicle mounted responder 35 have not yet been sent, but interrogatory signals to be sent from the antenna unit 17 to the vehicle mounted responder 35 are sent thereto.

As a result, the vehicle mounted responder 34 perform communication processing with the antenna unit 18, while the vehicle mounted responder 35 performs communication processing with the antenna unit 17. Hence, the vehicle mounted responders 34 and 35 individually and concurrently perform individual communication processings. Therefore, in this case, in comparison with the previously described case illustrated in FIGS. 19A through 19E, the entire communication time is shorter, allowing more efficient communication processing. That is, while the vehicles 32 and 33 passing through the communication areas 20 and 21, communication processings can exactly be performed.

According to the present invention as described above, the following effects can be obtained.

Firstly, as the communication areas are set by connecting the patches 30*a* through 30*h* of the antenna elements 22*a* through 24*b* with the transmission lines 31*a*, 31*b* and 31*c* having different impedances and thereby minimizing the side lobe, the unevenness of the communication areas 19, 20 and 21 due to the difference in height position can be minimized and thereby constant communication conditions can be secured.

Secondly, as it is so constructed that duplicated communication area is provided between the adjoining communication areas 19, 20 and 21 and pilot interrogatory signals are alternatingly transmitted, even if a vehicle runs astriding traffic lane, communication processing for such vehicle can be performed in any of the communication area.

Thirdly, as the length dimension La of the communication areas 19, 20 and 21 is set using the conditional equation (1), as long as a vehicle is in the running condition, the state in which communication is performed with the responder mounted on any other vehicle can be minimized.

Fourthly, as the transmission timing of the response signals of the vehicle mounted responder 34 (35) is set with a time slot selected at random from among a plurality of time slots, even if a plurality of vehicle mounted responders concurrently receive pilot interrogatory signals, it is possible to lower the probability of concurrently sending the pilot response signals and thereby prevent interference.

Fifthly, as an array antenna of microstrip type using the eight pieces of patches 30*a* through 30*h* as the antenna elements 22*a* through 24*b* respectively, it is possible to set communication areas of specified shapes with a certain degree of freedom.

Sixthly, as the communication areas 19, 20 and 21 are also set beneath the antenna units 16, 17 and 18 respectively, the occurrence of any dead zone of communication against the responders mounted on small vehicles or motorcycles running immediately behind large vehicles can be minimized and thereby communication processing can exactly been performed.

Figure 21:
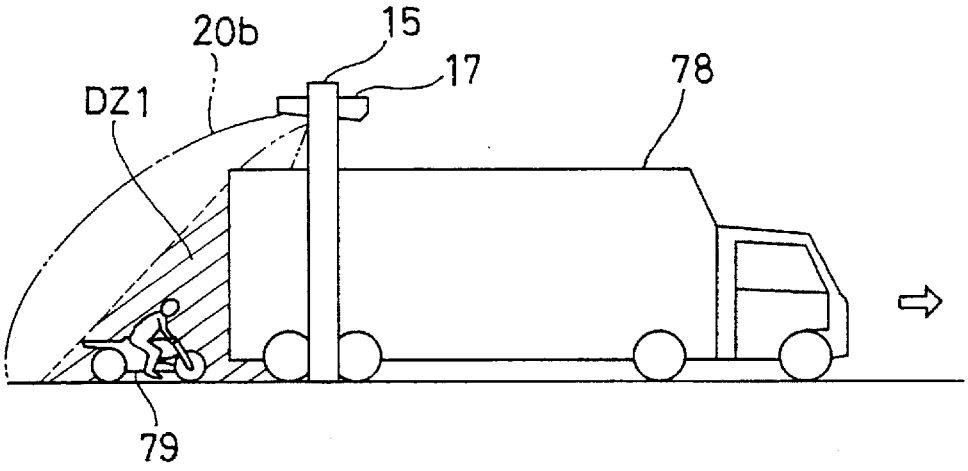
FIG. 21 is a side view for use in description of the communication condition of a motorcycle existing immediately behind a large vehicle (part I)

That is, as illustrated in FIG. 21, as a large vehicle 78 is tall, the large vehicle 78 shuts off the communication area 20 of the antenna unit 17 immediately behind there, forming a dead zone DZ1. As a result, when a motorcycle 79 is positioned on the side of the communicable area 20*b*, the motorcycle 79 is in the dead zone DZ1, and communication with the motor cycle 79 is impossible.

Figure 22:
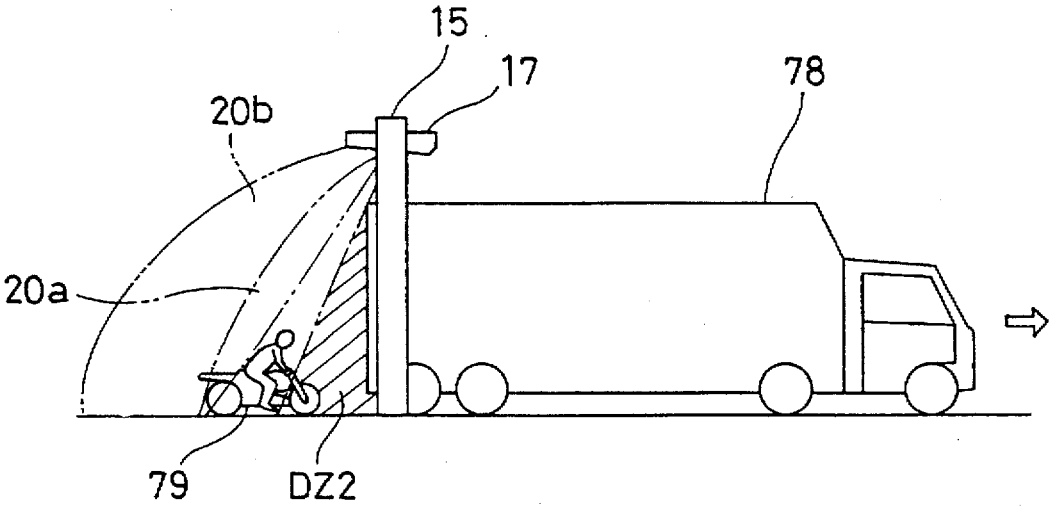
FIG. 22 is a side view for use in description of the communication condition of a motorcycle existing immediately behind a large vehicle (part II)
Figure 23:
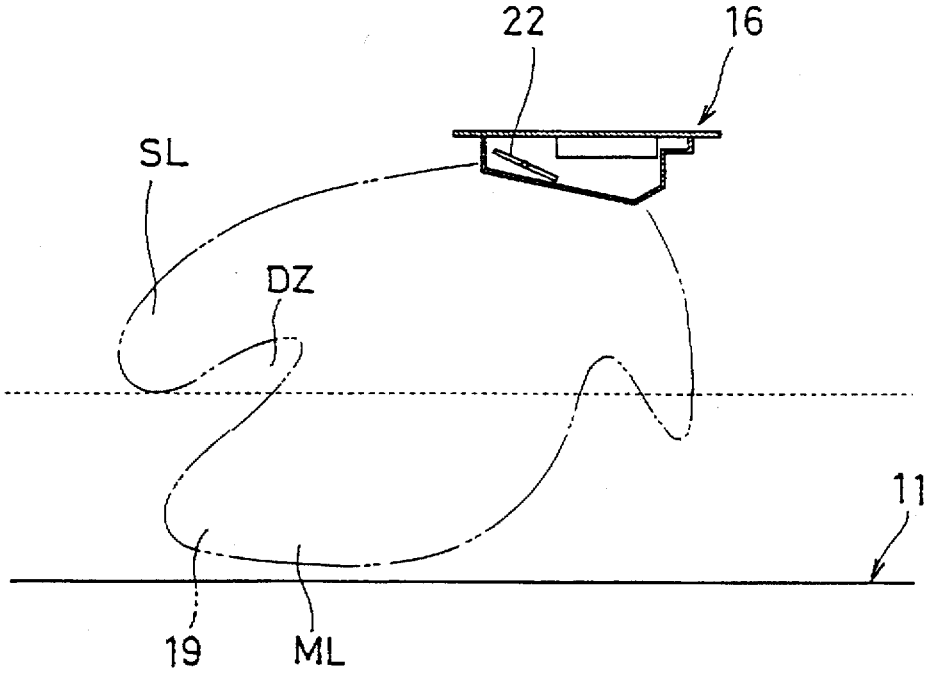
FIG. 23 PRIOR ART
FIG. 23 is a side view illustrating the shapes of the main lobe and side lobe of the conventional antenna unit.

However, in this embodiment, as the communication area 20 by means of the antenna unit 17 has set the communicable area 20*a* therebeneath, as illustrated in FIG. 22, as the large vehicle 78 passes through the antenna unit 17, the dead zone DZ1 becomes smaller like a dead zone DZ2. Hence the communicable area for the motorcycle 79 can be secured, and in this state, communication processing can exactly be performed and the toll collection data can be exchanged.

Seventhly, as it is so constructed that the IC card 66 is installed into the vehicle mounted responder 34 (35) for use, toll collection can be operated according to users.

It should be apparent to those skilled in the art that the present invention should not be limited to the above embodiment but may be modified or expanded as described below.

In addition to toll collecting operations for expressways, the present invention may be applied to charge collecting operations for pay garages. In this case, it may be so composed that vehicles concurrently enters from a plurality of traffic lanes, and there is no need for the drivers to stop at the entrance/exit for charge settlement. As a result, the efficient entrance and exit of vehicles can be achieved, and labor for charge collection can be reduced.

Furthermore, in addition to toll and charge collecting operations, the present invention may be applied to the exchange of various data for, such as the investigation of vehicle traffic condition. For example, the present invention may be applied to the investigation of traffic volume and the preparation of road information, to the urban traffic planning, or to the like.

The number of traffic lanes should not be limited to 3, but may be 2 or 4 or more.

The vehicle mounted responder may be so constructed as to be built in the vehicle instead of using the IC card.

The vehicle mounted responder should not be limited to such construction as to wake up upon receiving pilot interrogatory signals, but may be so constructed as to always in operation.

The antenna element may use any other means than patches.

The antenna element may be so constructed that the patches and the transmission lines are formed by thin film process by using a ceramic plate instead of the printed circuit board.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A communication system for vehicles, said system comprising:

an antenna unit disposed over a road for setting a communication area by operating at a specified oscillation frequency;

an antenna element provided within the antenna unit, said antenna element including a center patch and an end patch, a transmission line connecting the center patch and the end patch and a power supply terminal connected to the transmission line, an impedance of said end patch as seen from said power supply terminal being higher than an impedance of said center patch as seen from said power supply terminal, for sending an interrogatory signal to a vehicle; and a communication controlling means provided within the antenna unit for controlling transmission and receipt of signals at the antenna unit.

2. A communication system for vehicles according to claim 1, wherein the number and layout of the patches are determined according to a range of the communication area.

3. A communication system for vehicles according to claim 1, wherein the antenna unit comprises a first antenna element setting a communicable area beneath a part where the antenna unit is disposed, and a second antenna element setting a communicable area on a side farther than the communicable area of the first antenna element.

4. A communication system for vehicles according to claim 1, wherein the antenna elements comprises a direction adjusting means for adjusting a setting direction of the communication area.

5. A communication system for vehicles according to claim 1, wherein the antenna unit is provided for plurality over the road, and transmission frequency and transmission timing thereof differ from each other between adjoining antenna units.

6. A communication system for vehicles according to claim 1, wherein the antenna element is composed of a microstrip antenna.

7. A communication system for vehicles according to claim 1, wherein the antenna unit is disposed on a toll road and the communication system is so constructed as to exchange toll collection data necessary for traffic therethrough.

8. A communication system for vehicles according to claim 1, wherein the communication area has a length dimension approximately as much as or less than a length dimension of a vehicle.

9. A communication system for vehicles according to claim 1, further comprising:

a gantry disposed over said road, said antenna unit being disposed on said gantry;

wherein a communication area covered by said antenna unit includes a main lobe having a portion disposed in a path of a communicable portion of said vehicle and a side lobe disposed apart from said path of said communicable portion of said vehicle.

10. A communication system for vehicles according to claim 1, wherein said end part includes at least one patch.

11. A communication system for vehicles according to claim 1, wherein said end part has a communication area having a portion disposed in a path of said vehicle.

12. A communication system for vehicles according to claim 1, wherein said end part is connected to said power supply route independently of said central part.

13. A communication system for vehicles according to claim 1, wherein said communication controlling means is further for controlling transmission and receipt of signals at the antenna unit at least partially via said end part.

14. A communication system for vehicles according to claim 1, further comprising:

at least one additional center patch, said center patch and said at least one center patch being electrically connected to one another by a first portion of said transmission line; and at least one additional end patch, said end patch and said at least one additional end patch each being connected to a respective one of said center patch and said at least one additional center patch by a second portion of said transmission line.

15. A communication system for vehicles according to claim 14, wherein an impedance of said second portion of said transmission line is higher than an impedance of said first portion of said transmission line.

16. A communication system for vehicles according to claim 1, further comprising a vehicle mounted responder mounted on the vehicle for transmitting a response signal by modulating and reflecting unmodulated carrier waves received following the receipt of the interrogatory signal.

17. A communication system for vehicles according to claim 16, wherein:

the communication controlling means is so constructed that the plurality of antenna units repetitively output pilot interrogatory signals with a specified time interval, and that the antenna unit received a pilot response signal from a certain vehicle mounted responder of all the plurality of antenna units subsequently transmits the interrogatory signal to communicate with the certain vehicle mounted responder; and the vehicle mounted responder comprises a vehicle mounted response controlling means for outputting the pilot response signal to counter the pilot interrogatory signal upon receipt thereof and transmits the response signal in response to the interrogatory signal subsequently received.

18. A communication system for vehicles according to claim 17, wherein the vehicle mounted response controlling means transmits the response signal with a timing of a time slot selected at random from among a plurality of time slots when the vehicle mounted responder receives the pilot interrogatory signal.

19. A communication system for vehicles, said system comprising:

an antenna unit disposed over a road for setting a communication area by operating at a specified oscillation frequency;

an antenna element provided within the antenna unit, said antenna element including a center patch and an end patch, a transmission line connecting the center patch and the end patch and a power supply terminal connected to the transmission line, an impedance of said end patch as seen from said power supply terminal being different from an impedance of said center patch as seen from said power supply terminal, for sending an interrogatory signal to a vehicle, a portion of said interrogatory signal sent from said center patch being greater than a portion of said interrogatory signal sent from said end patch;

a communication controlling means provided within the antenna unit for controlling transmission and receipt of signals at the antenna unit;

wherein a communication area covered by said antenna unit includes a main lobe disposed at a position to be communicable with said vehicle and a side lobe disposed at a position where it is not communicable with said vehicle.

20. A communication system for vehicles according to claim 19, further comprising:

at least one additional center patch, said center patch and said at least one center patch being electrically connected to one another by a first portion of said transmission line; and at least one additional end patch, said end patch and said at least one additional end patch each being connected to a respective one of said center patch and said at least one additional center patch by a second portion of said transmission line.

21. A communication system for vehicles according to claim 20, wherein an impedance of said second portion of said transmission line is higher than an impedance of said first portion of said transmission line.

* * * * *